US011965505B2

(12) United States Patent
Crosio

(10) Patent No.: US 11,965,505 B2
(45) Date of Patent: Apr. 23, 2024

(54) PUMP

(71) Applicant: VHIT S.p.A., Offanengo (IT)

(72) Inventor: Pietro Francesco Crosio, Stradella (IT)

(73) Assignee: VHIT S.p.A., Offanengo (IT)

( * ) Notice: Subject to any disclaimer, the term of this patent is extended or adjusted under 35 U.S.C. 154(b) by 180 days.

(21) Appl. No.: 17/636,939

(22) PCT Filed: Aug. 19, 2020

(86) PCT No.: PCT/EP2020/073266
§ 371 (c)(1),
(2) Date: Feb. 21, 2022

(87) PCT Pub. No.: WO2021/032808
PCT Pub. Date: Feb. 25, 2021

(65) Prior Publication Data

US 2022/0275803 A1 Sep. 1, 2022

(30) Foreign Application Priority Data

Aug. 22, 2019 (IT) ..... 102019000014913

(51) Int. Cl.
*F04C 15/00* (2006.01)
*F04C 2/10* (2006.01)
(Continued)

(52) U.S. Cl.
CPC ..... *F04C 15/0096* (2013.01); *F04C 2/10* (2013.01); *F04C 29/047* (2013.01);
(Continued)

(58) Field of Classification Search
CPC .... F04C 15/0096; F04C 2/10; F04C 2240/40; F04C 2240/808; F04C 29/047;
(Continued)

(56) References Cited

U.S. PATENT DOCUMENTS

RE26,438 E * 8/1968 White ..... F04D 13/0613 417/357
5,997,261 A * 12/1999 Kershaw ..... F04D 29/5813 417/357

(Continued)

FOREIGN PATENT DOCUMENTS

CN 109458328 A 3/2019
DE 19948972 A1 4/2001

(Continued)

OTHER PUBLICATIONS

International Search Report and Written Opinion for Application No. PCT/EP2020/073266 dated Sep. 24, 2020 (11 pages).

(Continued)

*Primary Examiner* — Christopher S Bobish
(74) *Attorney, Agent, or Firm* — Michael Best & Friedrich LLP

(57) ABSTRACT

A pump (1) for pumping a working fluid includes an electric motor (3) for actuating the pump and a motor (3) having a stator (31) and a rotor (32) that interact for the actuation of the pump. The rotor (32) is rotatable about an axis of rotation (320). The pump includes an electronic unit (4) for controlling the electric motor (3), a conduit (5) for the delivery of the working fluid downstream of the pump, a line (6) for cooling the electric motor (3), and the electronic unit (4). The cooling line (6) is permanently open and drawing off some of the working fluid processed by the pump. The cooling line (6) includes a first conduit (61) which is developed from a delivery area (22) of the pump.

14 Claims, 8 Drawing Sheets

(51) Int. Cl.
*F04C 29/04* (2006.01)
*F04D 29/58* (2006.01)

(52) U.S. Cl.
CPC ..... *F04D 29/5806* (2013.01); *F04D 29/5813* (2013.01); *F04D 29/584* (2013.01); *F04D 29/588* (2013.01); *F04C 2240/40* (2013.01); *F04C 2240/808* (2013.01)

(58) Field of Classification Search
CPC ..... F04D 29/5806; F04D 29/5813; F04D 29/584; F04D 29/588
See application file for complete search history.

(56) References Cited

U.S. PATENT DOCUMENTS

| | | | | |
|---|---|---|---|---|
| 6,447,270 | B1 | 9/2002 | Schmidt et al. | |
| 6,884,043 | B2 * | 4/2005 | Kimberlin | F04C 14/06 417/357 |
| 10,323,654 | B2 * | 6/2019 | Zhang | F04D 13/0646 |
| 11,788,528 | B2 * | 10/2023 | Rosinski | F04D 29/58 417/213 |
| 2013/0259720 | A1 * | 10/2013 | Mills | H02K 5/203 417/410.1 |
| 2013/0302142 | A1 * | 11/2013 | Chiu | F04D 29/061 415/115 |
| 2016/0061221 | A1 * | 3/2016 | Lee | F04D 29/588 417/366 |
| 2017/0167491 | A1 | 6/2017 | Reul et al. | |
| 2019/0234406 | A1 * | 8/2019 | Homma | H02K 1/2791 |
| 2021/0123436 | A1 * | 4/2021 | Rosinski | F16H 57/0434 |
| 2021/0277894 | A1 * | 9/2021 | Homma | H02K 5/1735 |
| 2022/0325712 | A1 * | 10/2022 | Liu | F04C 15/0096 |

FOREIGN PATENT DOCUMENTS

| | | | |
|---|---|---|---|
| EP | 1361368 | A2 | 11/2003 |
| EP | 2378120 | A1 | 10/2011 |
| EP | 3073119 | A1 | 9/2016 |
| WO | 2017101922 | A1 | 6/2017 |
| WO | 2018159472 | A1 | 9/2018 |

OTHER PUBLICATIONS

Translation of Chinese Patent Office Action for Application No. 202080059381.4 dated Dec. 29, 2023 (5 pages).

* cited by examiner

PUMP

BACKGROUND OF THE INVENTION

The present invention relates to a pump, particularly a type of pump known as an ELOP (ELectric Oil Pump). It may be used to send a working fluid (for the purpose of lubrication and/or cooling and/or actuation, for example) to a transmission, possibly an electric axle transmission ("e-Axle"), for example, or a "torque vectoring" differential, or other static or dynamic applications. A pump of this type comprises pumping means, an electric motor actuating the pumping means, and an electronic unit for controlling the electric motor.

There are known ELOP pumps in which some of the working fluid, before being processed by the pumping means, is tapped off and used for cooling the electronic circuit board and/or the electric motor. The working fluid is then sent to a device served by the pump and located at the delivery end.

A drawback of this solution arises from the suction pressure drop at the pumping section, since some of the fluid is sent to the cooling conduits of the electric motor.

SUMMARY OF THE INVENTION

The object of the present invention is to propose a pump which will make it possible to avoid suction pressure drops while optimizing the distribution of the fluid and consequently the cooling.

The stated technical aim and the specified objects are substantially achieved by a pump having the technical characteristics described in one or more of the appended claims.

BRIEF DESCRIPTION OF THE DRAWINGS

Further characteristics and advantages of the present invention will be more readily apparent from the description, which is for guidance and therefore non-limiting, of a pump as illustrated in the appended drawings, in which.

DETAILED DESCRIPTION

Figure 1:
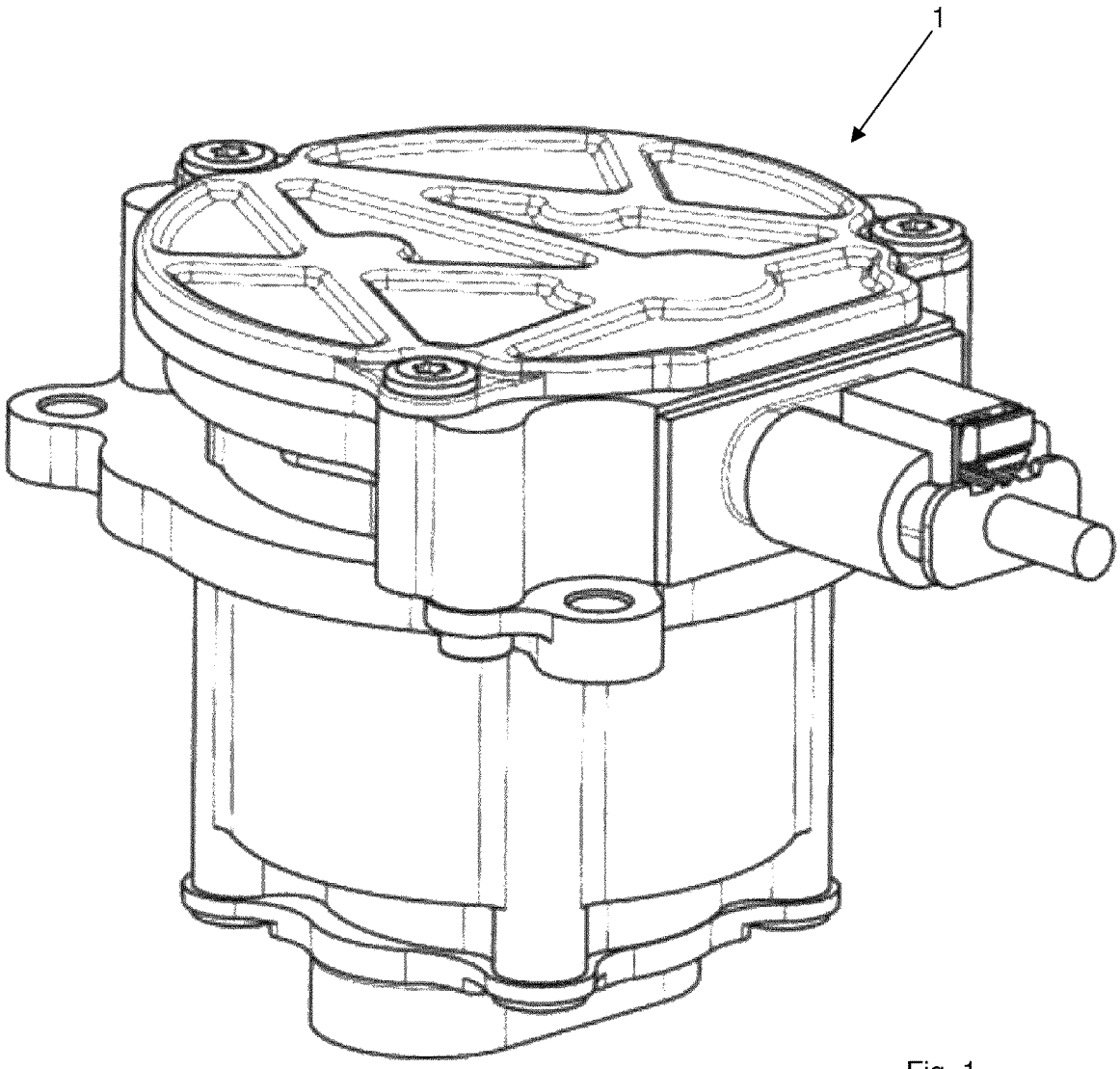
FIG. 1 shows a perspective view of a pump according to the present invention.

In the appended figures, the reference numeral 1 indicates a pump, particularly an ELOP (ELectric Oil Pump). Conveniently, this pump 1 processes a working fluid which is oil, but it could also process other types of working fluid (typically of an incompressible type).

The pump 1 conveniently comprises means 2 for pumping a working fluid. Conveniently, the pumping means 2 comprise a gear pumping device (but could alternatively comprise a vane pump, a centrifugal pump, or other type). Preferably the pumping means 2 comprise a first and a second gear wheel, positioned one inside the other and engaging with one another (this solution is also known in the art as a gerotor). Conveniently, the pumping means 2 comprise one or more inlets.

The pump 1 further comprises an electric motor 3 for actuating the pumping means 2. Preferably, but not necessarily, the motor 3 is a brushless motor. The motor 3 comprises a stator 31 and a rotor 32 that interact for the actuation of the pumping means 2. The rotor 32 is rotatable about an axis 320 of rotation. Conveniently, the pump 1 comprises a transmission shaft 33, actuated by the motor 3, which drives at least part of the pumping means 2 in rotation. The rotor 32 is integral with the shaft 33. On the other hand, the stator 31 is fixed to a pump casing 80. The stator 31 preferably comprises windings 310. These windings 310 define the pole tips.

The pump 1 conveniently comprises an electronic unit 4 for controlling the electric motor 3. The electronic unit 4 therefore enables the movement of the electric motor 3 to be regulated. The electronic unit 4 is conveniently multi-functional. The electronic unit 4 (at least one electronic circuit board, for example) is conveniently housed and secured in the pump casing 80.

Figure 11:
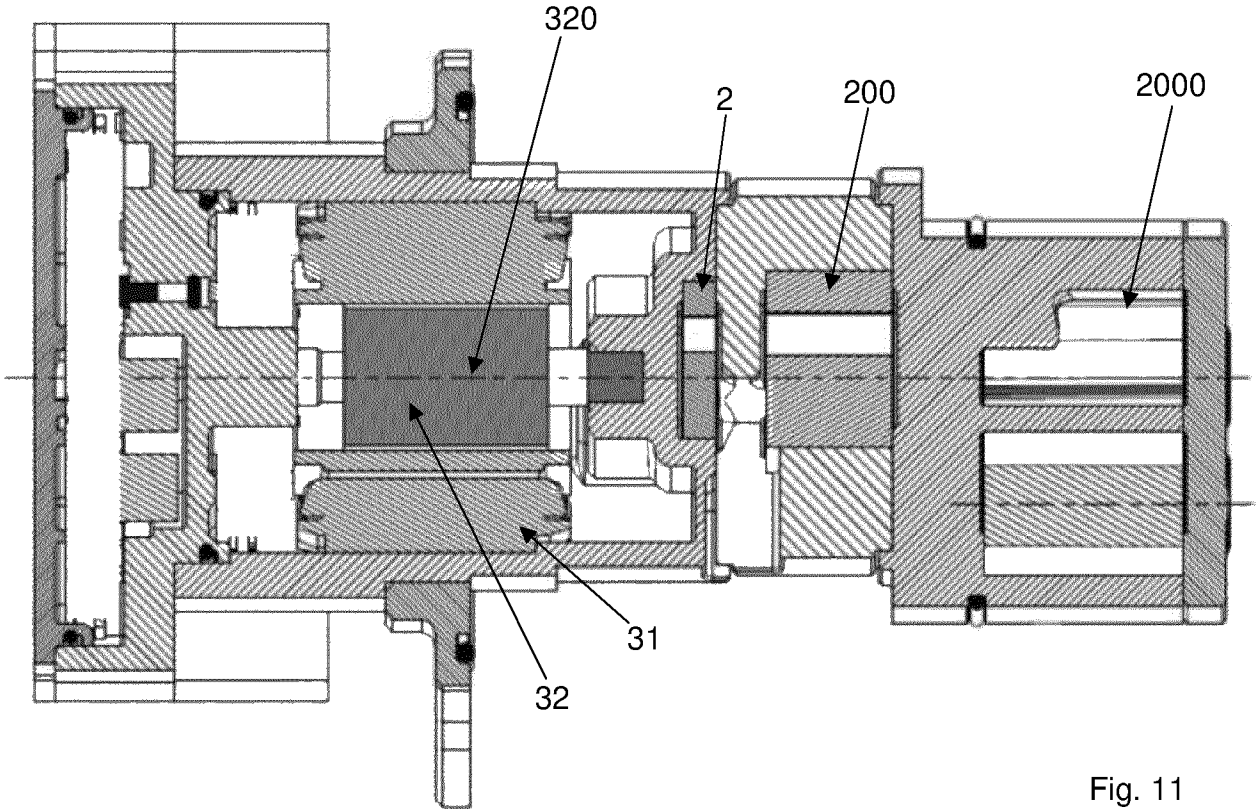
FIG. 11 shows a further constructive solution for a pump according to the present invention.

The pump 1 may comprise additional pumping means 200. In this case, the pump 1 may be termed a "tandem pump". Conveniently, the additional pumping means 200 are actuated by the same electric motor 3 that actuates the pumping means 2. Conveniently, the pumping means 2 and the additional pumping means 200 are coaxial. The additional pumping means 200 may send the working fluid, outside the pump 1, to the same user as the pumping means 2 described above, or to a different user. Additionally, the pumping means 2 and the additional pumping means 200 may be supplied from independent conduits in suction. In the preferred solution, the pumping means 2 are nearer to the electric motor 3 than the additional pumping means 200. Conveniently, the pump 1 may comprise second additional pumping means 2000 (in respect of which the description given above for the additional pumping means 200 may advantageously be repeated). For example, FIG. 11 shows pumping means 2, additional pumping means 200 and second additional pumping means 2000.

The pump 1 comprises a conduit 5 for the delivery of the working fluid. This conduit 5 is downstream of the pumping means 2. It enables the working fluid (typically oil) to be sent to at least one user outside the pump 1, as described above, for example.

The pump 1 further comprises a line 6 for cooling the electric motor 3 and the electronic unit 4. Preferably, the cooling line 6 is permanently open and draws off some of the working fluid processed by the pumping means 2. Thus there are no check valves which would either impede the flow of the working fluid or allow it only when a predefined pressure was exceeded.

The cooling line 6 conveniently comprises a first conduit 61 which is developed from a delivery area 22 of the pumping means 2. This first conduit 61 is therefore a bleed-off for the working fluid which is used for cooling the motor 3 and the electronic unit 4. The first conduit 61 is conveniently a calibrated conduit. It is conveniently designed and/or forms a suitable constriction. Conveniently, the delivery conduit 5 and the first conduit 61 are developed from two opposite sides of the pumping means (2). The first conduit 61 has an inlet 610.

Conveniently, in the preferred non-limiting solution, a mouth 51 of the delivery conduit 5 and the inlet 610 of the first conduit 61 face two opposite sides of the pumping means 2. In particular, the delivery conduit 5 and the first conduit 61 are developed from a high-pressure area of the pumping means 2. Conveniently, the flow of the working fluid through the first conduit 61 is regulated, preferably in flow rate or in pressure, so as to generate a heat exchange which is uniformly distributed in the electrical/electronic parts. The flow of the working fluid is calibrated in the phase of design and testing of the pump 1 on the basis of the requirements of the specific application (for example, at the maximum temperature combined with the minimum pressure; by doing this in all the other operating conditions of the pump, it will be ensured that the oil flow rate is sufficient for the purpose).

In a preferred mounting configuration of the pump 1, the first conduit 61 is located in a lower area of the pump 1. In particular, in the preferred mounting configuration, the first conduit 61 is located below the axis of rotation 320 (this condition being ascertained in an area lying between two vertical planes located at the inlet and outlet of this first conduit 61). In particular, in the preferred mounting configuration, the axis of rotation 320 is in a substantially horizontal position. Thus the electric motor 3 is in an automatic air vent condition. However, the pump 1 may also be mounted vertically or at any intermediate angle between horizontal and vertical. In this case, the installation may take place in two possible orientations, particularly with the electronic unit 4 positioned at the top or at the bottom. The solution with the electronic unit 4 at the bottom is to be preferred between the two possible orientations, but even if the electronic unit 4 is positioned at the top the pumping means 2 draw the working fluid back by suction (as will be clearer in the rest of the description) and therefore the outflow of the air is still permitted. Alternatively, the pump 1 may be installed in any orientation and any direction intermediate between the solutions described.

Conveniently, the electric motor 3 is interposed between the pumping means 2 and the electronic unit 4. Conveniently, the pump 1 comprises a housing 20 for the pumping means 2, a housing 30 for the electric motor 3 and a housing 40 for the electronic unit 4. The housing 20 for the pumping means 2 and the housing 30 for the electric motor 3 are adjacent to one another. The housing 30 in which the electric motor 3 is positioned is in fluid communication with the housing 20 in which the pumping means 2 are positioned. Conveniently, the housing 30 is at least partially filled with working fluid (in the preferred solution it is entirely filled, or at least 90% filled). The motor 3 is therefore at least partially, preferably entirely, or at least 90% immersed in the working fluid. Conveniently, the housing 40 in which the electronic unit 4 is positioned is separated from the housing 30 in which the electric motor 3 is positioned. Conveniently, the housing 40 in which the electronic unit 4 is positioned is fluid-dynamically isolated from the housing 30 in which the electric motor 3 is positioned. This typically takes place by means of a fluid-tight heat-conducting wall 41. This is conveniently shaped to optimize the heat exchange (for example, it has a smaller thickness where greater cooling is required). The working fluid from the pumping means 2 does non penetrate into the housing 40. The electric motor 3 is cooled and lubricated with the working fluid processed and sent by the pumping means 2.

Figure 6:
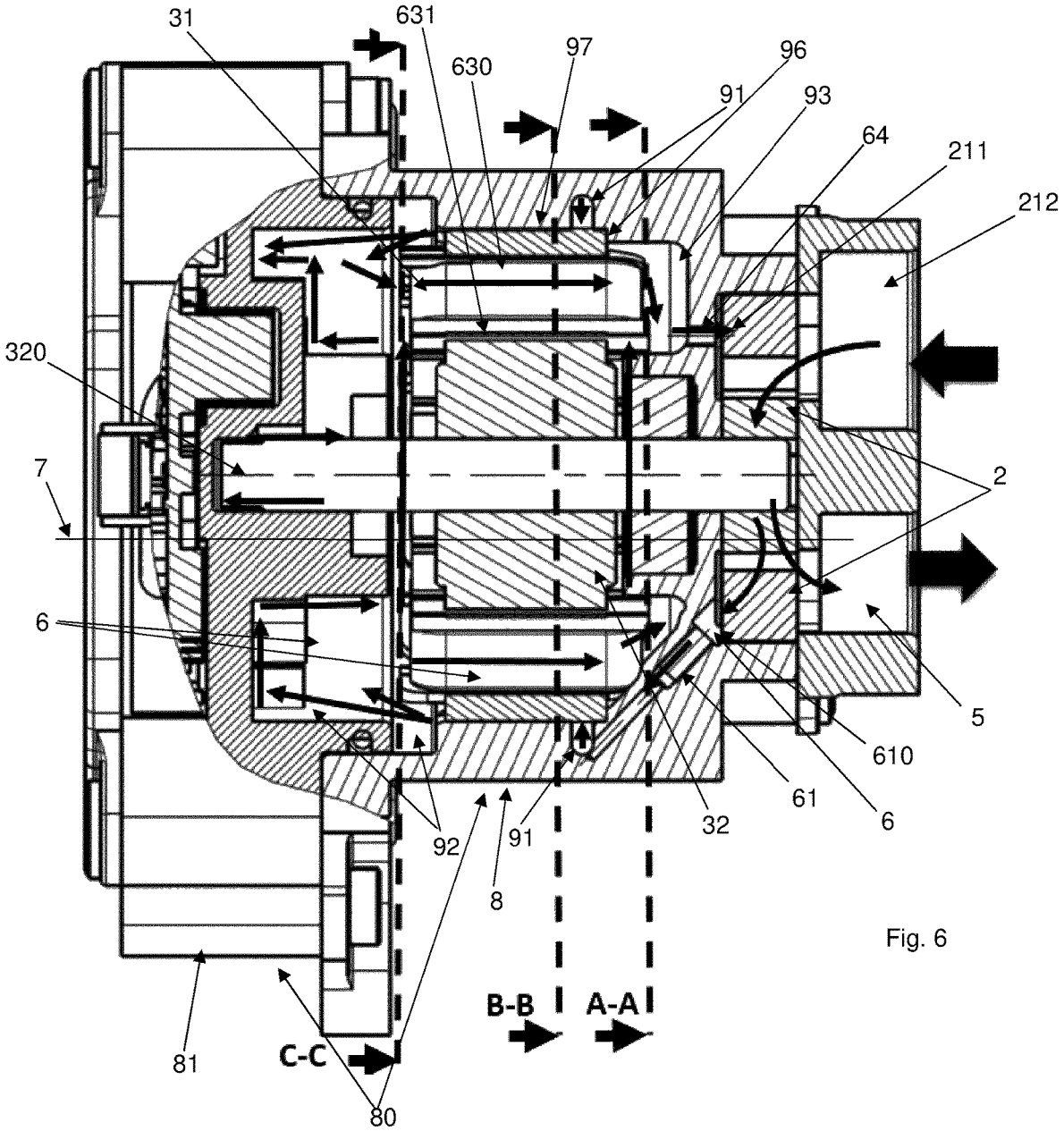
FIG. 6 shows a sectional view of a second constructive solution for a pump according to the present invention.

As shown by way of example in FIG. 6, at least one imaginary straight line 7, parallel to the axis of rotation 320, intercepts said motor 3 (the stator 31 or the rotor 32, said electronic unit 4 and said pumping means 2. These elements are therefore axially assigned.

As indicated above, the working fluid for cooling the motor 3 and the electronic unit 4, downstream of the pumping means 2, encounters the first conduit 61 (in the present description, the expressions "upstream" and "downstream" refer to the flow of the working fluid). The first conduit 61 is developed longitudinally and has orthogonal sections (relative to the longitudinal development) that are convex.

Conveniently, the first conduit 61 defines at least one fluid passage cross section which, when ascertained orthogonally to said line of longitudinal development, is convex. Conveniently, for at least 90% of the longitudinal development, this fluid passage cross section, when ascertained orthogonally to said line of longitudinal development, is convex. Within the first conduit 61 the working fluid does not contact the shaft 33.

As mentioned above, the inlet 610 of the first conduit 61 faces the pumping means 2.

The pump 1 comprises an outer shell 8 which at least partially encloses the motor 3. It forms part of the pump casing 80. The first shell 8 conveniently surrounds the stator 31 and the rotor 32. The pump casing 80 also comprises a cover 81 that is joined to said shell 8 and defines the housing of the electronic unit 4. The first conduit 61 is surrounded and defined by said shell 8. This outer shell 8 that surrounds and defines the first conduit 61 is a single one-piece casing. Conveniently, the first conduit 61 comprises a plurality of successive portions in which the passage cross section is progressively reduced. Conveniently, the first conduit 61 has at least one passage cross section defined by a single perimetric line closed on itself, and conveniently circular. Preferably there are no bodies within the first conduit 61.

The first conduit 61, along its development, extending away from the pumping means 2, extends away from said axis of rotation 320 of the rotor 32. The first conduit 61 is developed until it meets an area adjacent to the area in which the shell 8 is fastened (by an interference fit or bonding, for example) to the stator 31.

Figure 2:
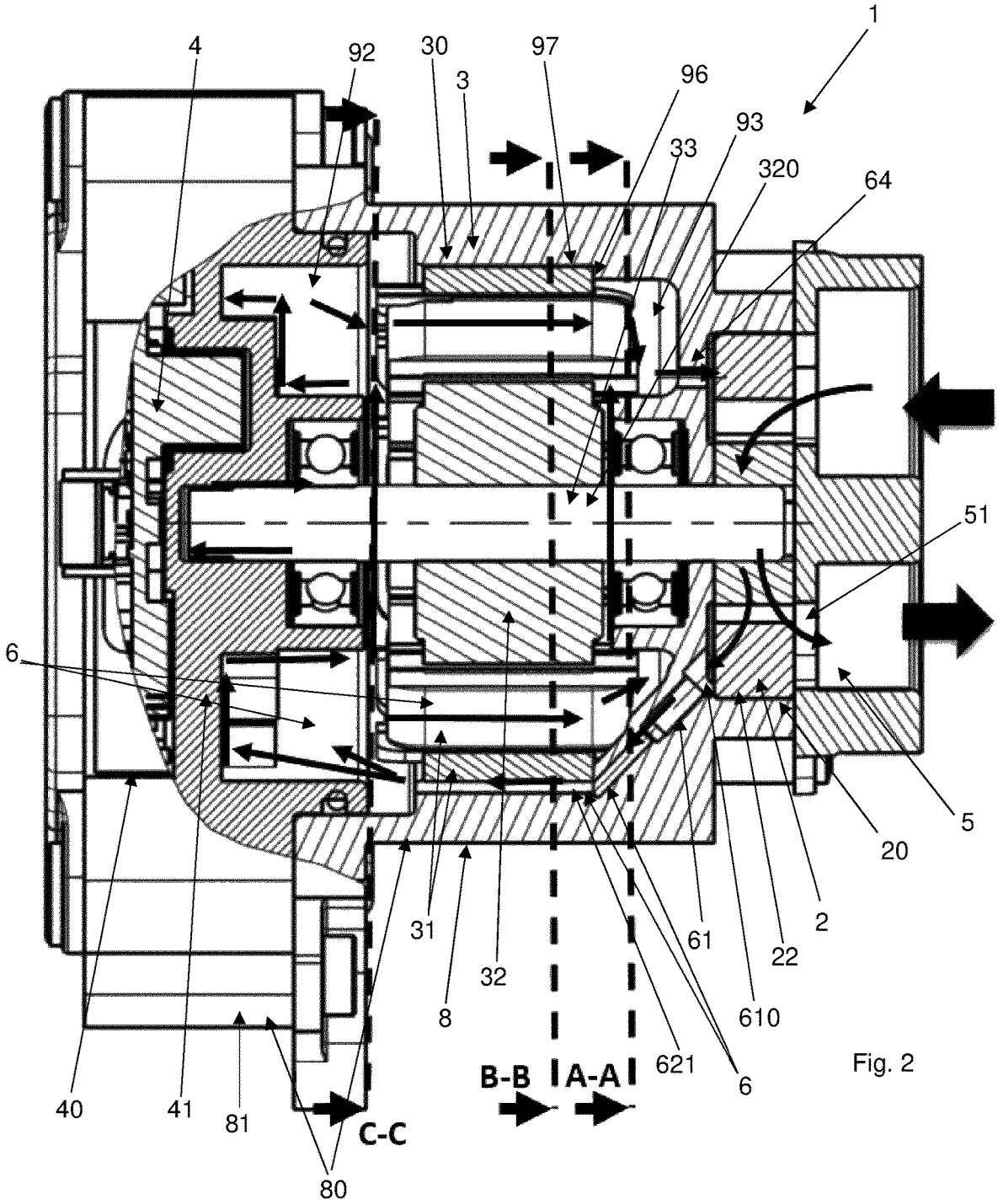
FIG. 2 shows a sectional view of a first constructive solution for a pump according to the present invention.
Figure 3:
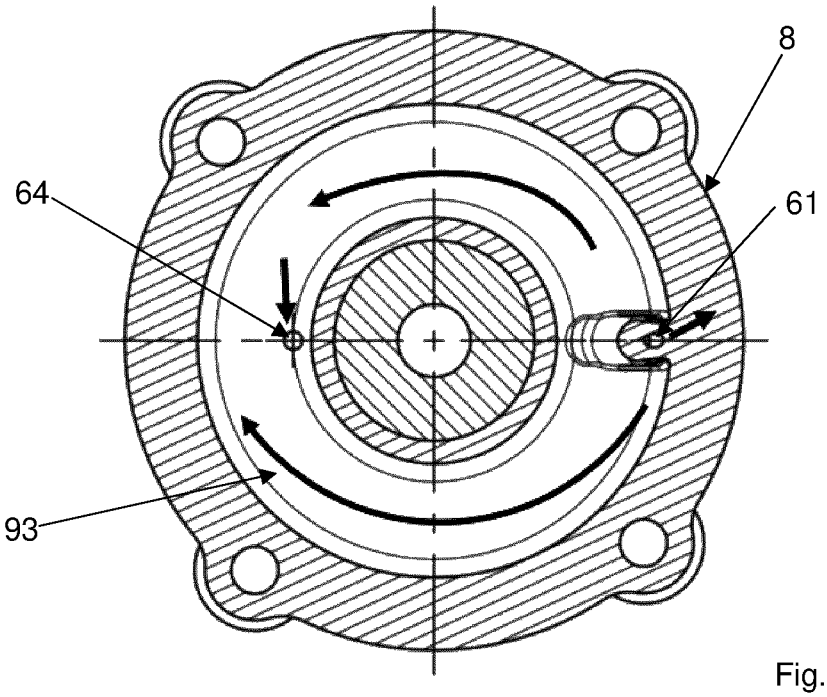
FIG. 3 is a sectional view taken through the section plane A-A of FIG. 2 or FIG. 6.
Figure 4:
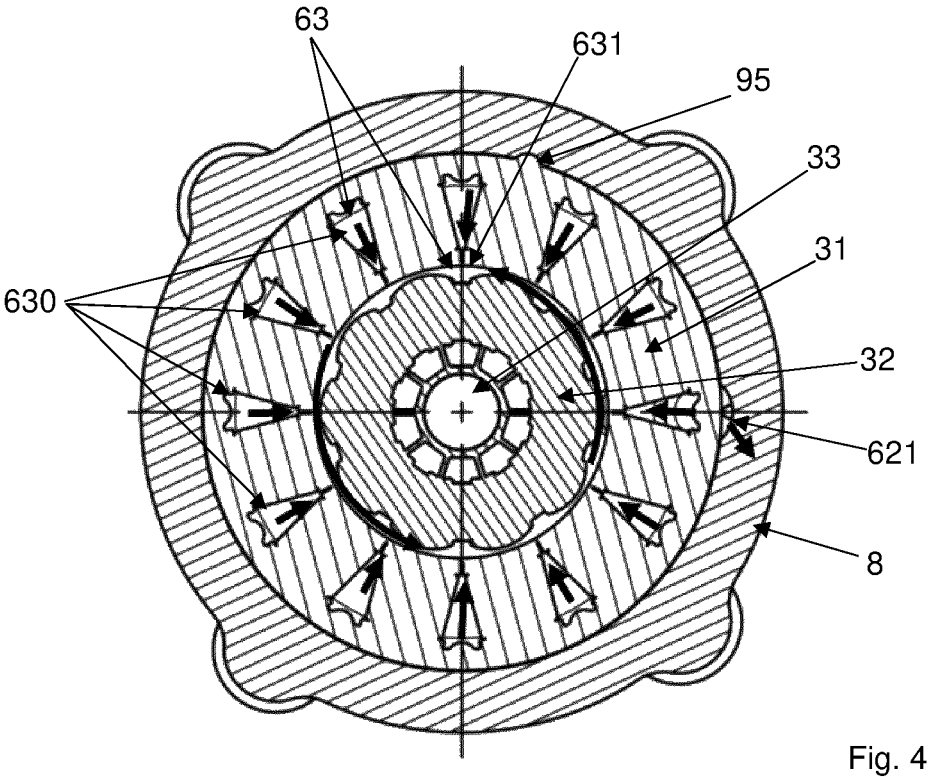
FIGS. 4 and 5 show views in cross section taken, respectively, through the section planes B-B, C-C of FIG. 2.
Figure 5:
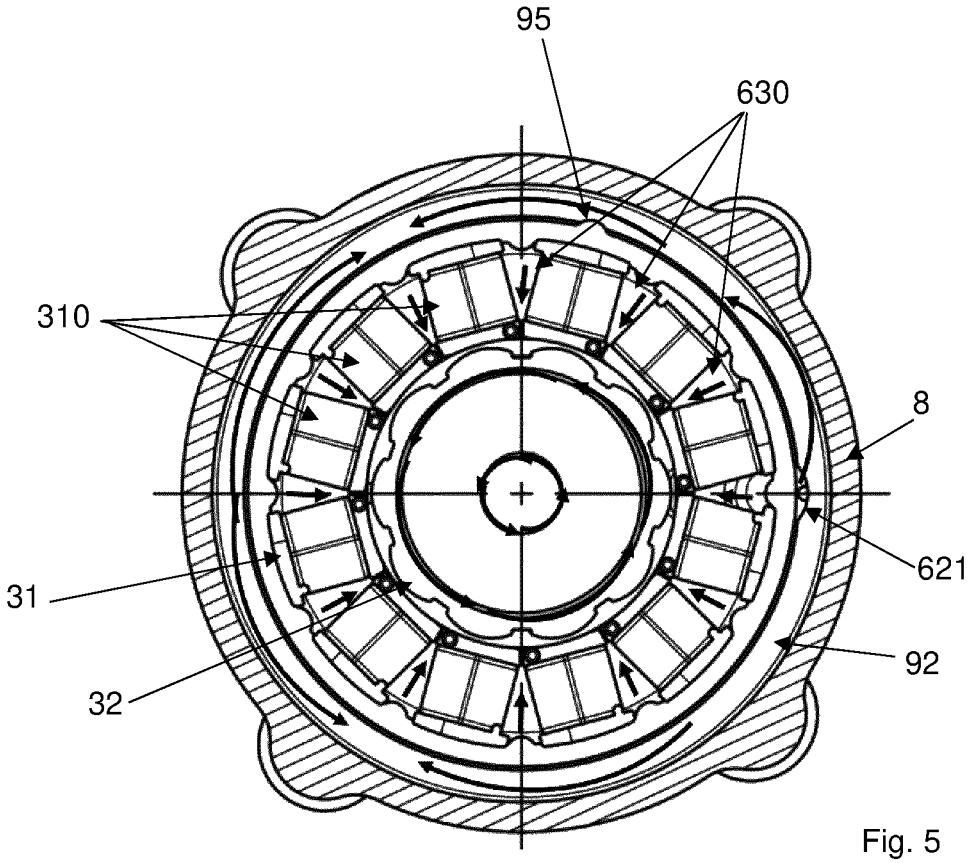

As shown by way of example in FIG. 2 or 6, the first conduit 61 has a straight longitudinal axis of development. It is developed from a chamber in which the pumping means 2 are positioned.

Conveniently, the cooling line 6 (in other words, the line intended for cooling the motor 3 and the electronic unit 4) comprises a single outlet line from said housing 20 (chamber) that houses the pumping means 2. This outlet line is defined by the first conduit 61. In an alternative solution, the cooling line 6 could comprise a plurality of outlet lines from the housing 20.

As shown by way of example in FIG. 2, the cooling line 6 conveniently comprises at least a first cavity 621 in which said working fluid circulates. The first cavity 621 is located downstream of the first conduit 61. The first conduit 61 and said first cavity 621 convey the working fluid away from the pumping means 2. Conveniently, the first cavity 621 (in particular, at least a section orthogonal to the longitudinal development) is partially defined by the stator 31 and partially by the shell 8. The passage from the first conduit 61 to the first cavity 621 is marked, for example, by a change in direction of the working fluid. If necessary, however, the working fluid could follow the same direction. Conveniently, the first cavity 621 is defined solely by the combination of the stator 31 and the shell 8. The first cavity 621 defines a concavity which extends into the shell 8 without extending into the stator 31 (therefore the stator 31 does not have a concavity that defines the first cavity 621; instead, the part of the stator 31 that contributes to defining the first cavity 621 is convex). This is because shaping the shell 8 is less costly than shaping the stator 31, and may be carried out, for example, in the forging or casting process; this enables the costs to be reduced. The first cavity 621 is located downstream of the first conduit 61. In the solution of FIG. 2, the first cavity 621 is the continuation of the first conduit 61 (but with a different direction of development; if necessary, it could follow the same direction).

Figure 7:
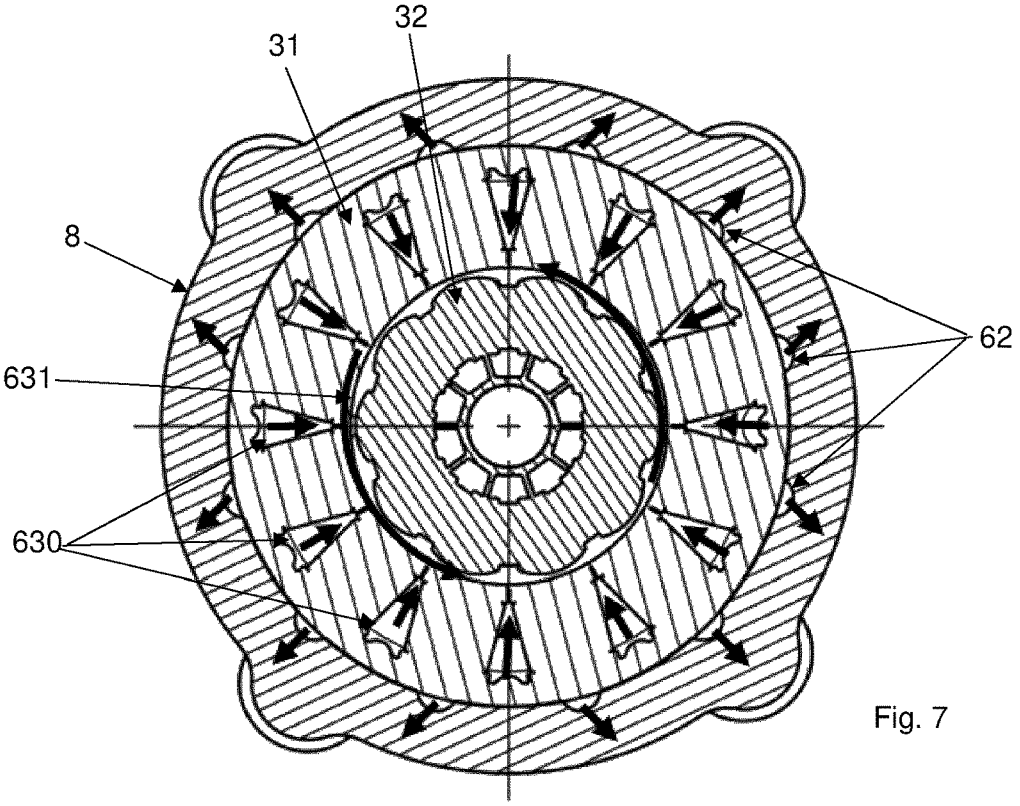
FIGS. 7 and 8 show sectional views taken, respectively, through the figure planes B-B, C-C of FIG. 6.
Figure 8:
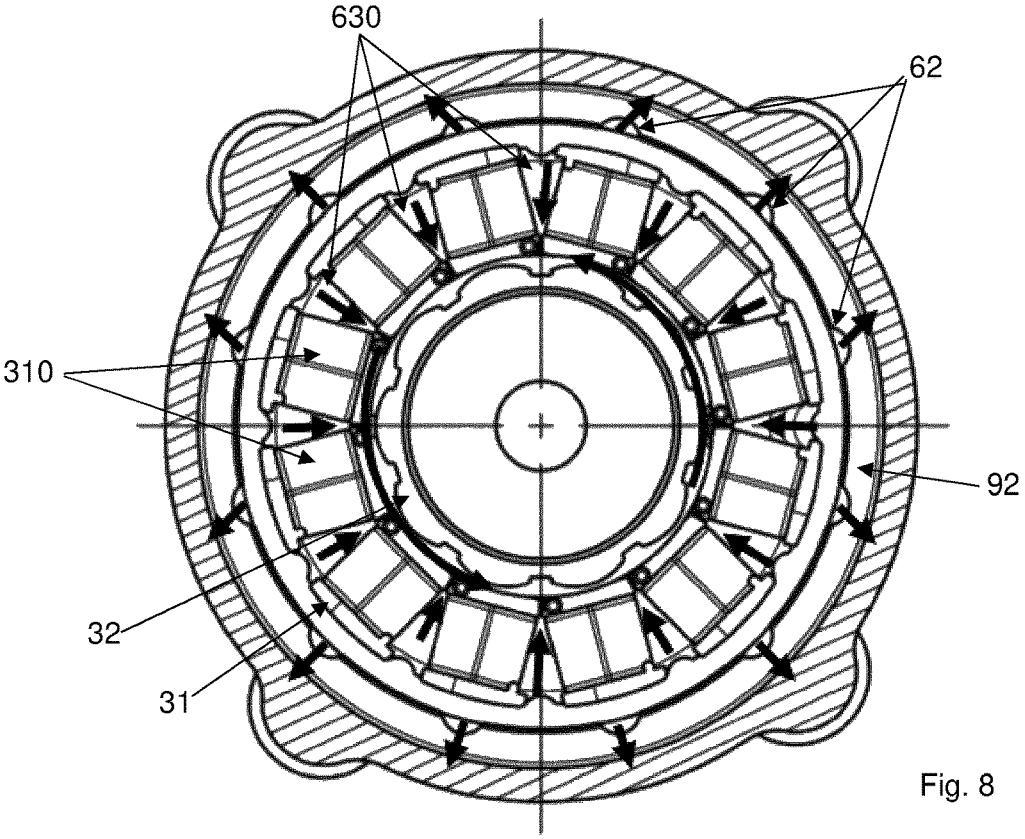

In an alternative solution shown in FIGS. 6-8 (and also in the solution of FIGS. 9 and 10), the cooling line 6 comprises (and, in particular, branches into):

- a delivery manifold 91 (this may have a constant or variable transverse section relative to the line of development; this enables the delivery pressures to be better controlled for the purpose of optimal flow calibration);
- a plurality of cavities 62.

In the present description, "manifold" is taken to mean a chamber into which or from which a number of conduits and/or interstices and/or cavities open or are developed. It therefore has the function of collecting and/or distributing the working fluid.

Conveniently, the cooling line 6 comprises a plurality of delivery conduits (solution not shown) which conveniently connect the delivery area 22 of the pumping means 2 to the delivery manifold 91.

As described above, upstream of said at least a first cavity 621 (or in any case upstream of the delivery manifold 91), the cooling line 6 comprises the first conduit 61 with a convex transverse section which is developed from a delivery area 22 of the pumping means 2.

The first conduit 61 opens into the delivery manifold 91 (see FIG. 6) or directly into the first cavity 621 (see FIG. 2). The first conduit 61 and said first cavity 62 convey the working fluid away from the pumping means 2.

The first cavity 621 forms part of said plurality of cavities 62.

The plurality of cavities 62 are developed from the delivery manifold 91. Said working fluid passes through said plurality of cavities 62. The plurality of cavities 62 are distributed around the stator 31.

The delivery manifold 91 distributes the working fluid (which is a cooling fluid) into the various cavities 62.

These cavities 62 are partially defined by the stator 31 and partially by the shell 8.

The delivery manifold 91 and the cavities 62 are conveniently calibrated. They are conveniently designed and/or form a suitable constriction.

The delivery manifold 91 conveniently has an annular development. Conveniently, it comprises/is a groove formed in said shell 8. This groove is annular. A wall of this delivery manifold 91 is advantageously defined by the stator 31.

The first cavity 621 and/or the plurality of cavities 62 and/or the delivery manifold 91 are preferably defined by concavities formed at least partially in the shell 8 (preferably only in the shell 8), typically by forging and/or casting or by working with a machine tool after the forging and/or casting.

Conveniently, the cavities 62 extend into the shell 8 without extending into the stator 31. As described above, the cavities 62 are defined by concavities which extend inside the shell 8 and which face the stator 31. The cavities 62 could therefore be defined by radiating cells. Conveniently, the stator 31 has an outer surface free of concavities (appearing substantially smooth) at the positions of the cavities 62. Conveniently, the stator 31 comprises at least one reference 95 for angular positioning relative to the shell 8 (a protrusion, for example). This is useful for orientating the phases. For example, the stator 31 may therefore comprise an outer surface which is cylindrical with the exception of said at least one angular reference 95.

In an alternative solution, the cavities 62 may be at least partially formed in the stator 31, in a stator with projections for example.

Conveniently, the cavities 62 are distributed with equal circumferential spacing. The cavities 62 could, for example, be developed parallel to one another. Conveniently, in the preferred but not exclusive solution, they are developed longitudinally in a direction parallel (or substantially parallel) to the axis of rotation 320 of the rotor 32. In an alternative solution they could, for example, be developed helically.

Conveniently, the cooling line 6 comprises a heat exchange manifold 92 into which the first cavity 621 opens, intended to cool the electronic unit 4. Conveniently, said plurality of cavities 62 opens into the heat exchange manifold 92. The heat exchange manifold 92 provides greater uniformity in the outlet pressure of the fluid leaving the various cavities 62. The heat exchange manifold 92 contacts the wall 41 of said housing 40.

Figure 9:
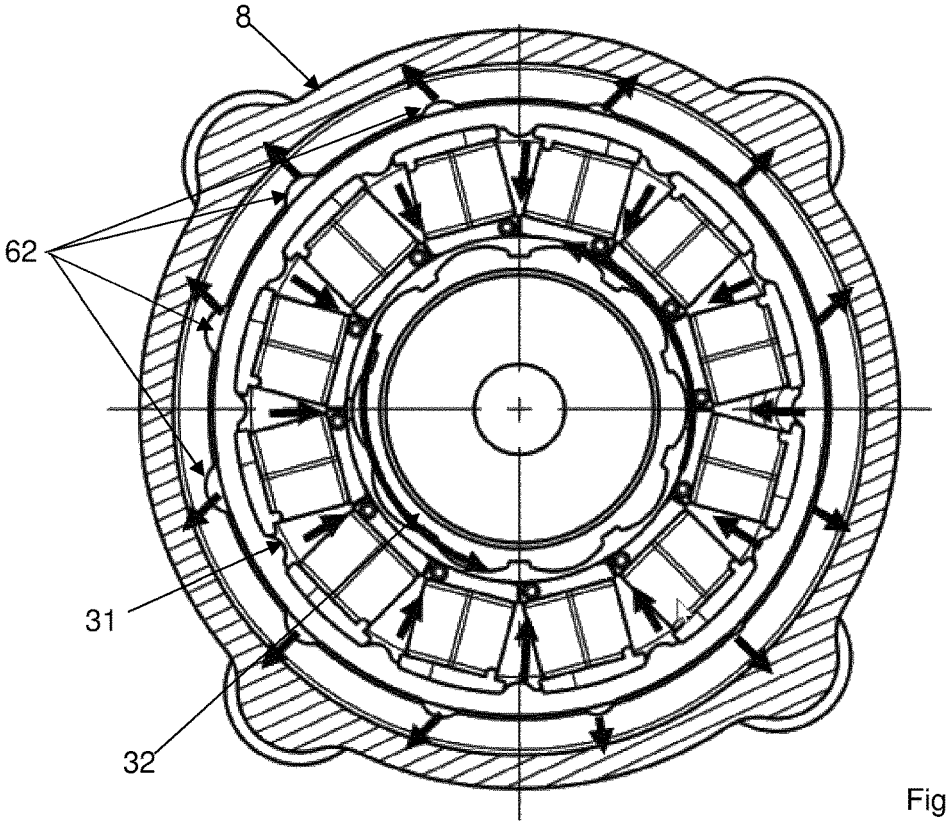
FIG. 9 shows an alternative solution to that shown in FIG. 8.
Figure 10:
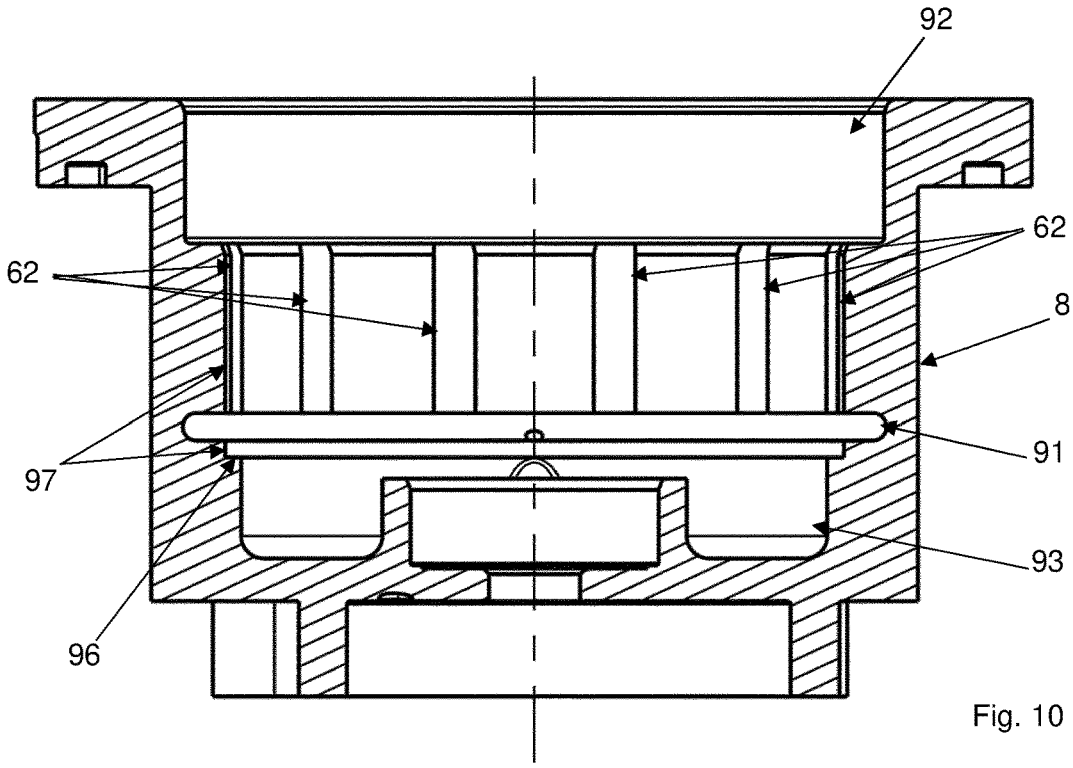
FIG. 10 shows a component of the pump of FIG. 6.

As shown by way of example in FIG. 9, in at least a plane orthogonal to the axis of rotation 320 of said rotor 32, at least two of said cavities 62 have different cross sections from one another (a provision made on the assumption of large pressure drops due to a small passage cross section of the manifold 91). Conveniently, this enables the flow rate at the inlet to the heat exchange manifold 92 to be made circumferentially uniform and equally distributed. In particular, the cross section of said cavities 62 increases progressively along a circular development.

In particular, the first conduit 61 opens into the delivery manifold 91 at the point equidistant from and nearest to the cavities 62 having the greatest constriction and opposite the cavities with larger cross sections.

In the solution of FIG. 8, in at least a plane orthogonal to the axis of rotation 320 of said rotor 32, at least a plurality of said cavities 62 have equal cross sections to one another (a provision made on the assumption of negligible pressure drops in the manifold 91), so as to make the flow rate at the inlet of the heat exchange manifold 92 circumferentially uniform and equally distributed.

The cooling line 6 conveniently comprises a return manifold 93 positioned downstream of the heat exchange manifold 92.

Conveniently, the heat exchange manifold 92 is annular. Conveniently, the heat exchange manifold 92 is positioned behind the housing 40 of the electronic unit 4.

Conveniently, the return manifold 93 is annular. Conveniently, it is positioned on the opposite side of the heat exchange manifold 92 from the stator 31. The stator 31 lies entirely between the heat exchange manifold 92 and the return manifold 93.

The cooling line 6 also comprises means 63 for the communication of fluid from said heat exchange manifold 92 to said return manifold 93. This conveniently takes place by passing through the stator 31. The means 63 are therefore defined at least partially by the stator 31. Conveniently, the stator 31 is contacted by at least some of the working fluid that passes through the means 63. The working fluid passing through the means 63 therefore contacts the stator 31. Preferably, the means 63 comprise all the interstices (or channels) through which the working fluid passes from the manifold 92 to the manifold 93, and each of these interstices (or channels) is defined at least partially by the stator 31.

At least some of the fluid that passes through the means 63 contacts the rotor 32.

The fluid communication means 63 comprise a plurality of return interstices 630 that are developed between the heat exchange manifold 92 and the return manifold 93.

Conveniently, the return interstices 630 may pass through the stator 31 internally.

Preferably, the return interstices 630 are developed between the windings 310 of the stator 31. In particular, these return interstices 630 alternate with the windings 310.

In other words, the cooling line 6 comprises return interstices 630 which are fluid-dynamically and possibly also geometrically in parallel, and which extend from said heat exchange manifold 92 towards the pumping means 2, passing through the stator 31 of the motor 3. Conveniently, the return interstices 630 are joined together in the return manifold 93.

Additionally or alternatively, the fluid communication means 63 may comprise a circular return channel 631 defined between the rotor 32 and the stator 31 (air gap).

Conveniently, the shell 8 comprises a stop 96 for the stator 31. This stop 96 is developed towards the axis of rotation 320, and preferably has a radial development.

Conveniently, the shell 8 comprises an inner surface 97 that encloses the stator 31 and is fastened to the stator 31.

Conveniently, the pump 1 comprises a fluid-dynamic seal area between the shell 8 and the stator 31. This fluid-dynamic seal fluid-dynamically separates the delivery manifold 91 (in the case of the solution of FIG. 6, for example) or the first cavity 621 (in the case of the solution of FIG. 2) from the return manifold 93. This prevents the working fluid from by-passing the heat exchange manifold 92. Conveniently, this fluid-dynamic seal area between the shell 8 and the stator 31 is located at the position of the stop 96 and/or of at least one portion of the surface 97.

Conveniently, the pump 1 comprises at least one recirculation passage 64, enabling the working fluid present in the return manifold 93 to be recirculated to the pumping means 2. In particular, the passage 64 puts said return manifold 93 into fluid communication with an area (of the pump 1, for example) located upstream of the pumping means 2.

The means 63, and conveniently the passage 64, enable the working fluid to be returned to the pumping means 2 (or in any case contribute to the return).

In one solution (shown in FIG. 2 or 6, for example) the recirculation passage 64 connects the return manifold 93 to a first suction area 211 of the pumping means 2. Through this first suction area 211, the working fluid used for cooling the electric motor 3 and the electronic unit 4 is recirculated into the pumping means 2. Conveniently, the pump 1 comprises a second area 212 for the suction of the working fluid into the pumping means 2. Conveniently, the first and second suction areas 211, 212 in the preferred but non-limiting solution face two opposite sides of the pumping means 2. The higher pressure of the cooling fluid relative to the fluid in suction into the pumping means 2, combined with the rotation of the pumping means 2, contributes to the prevention of returns of the working fluid through the recirculation passage 64. In an alternative solution which is not shown, the recirculation passage 64 may connect the return manifold 93 to a reservoir from which the pump 1 draws the working fluid. This reservoir is typically outside the pump 1.

The present invention yields significant advantages.

Firstly, it enables pressure drops to be avoided in suction. At the same time, it enables the electronic unit and electric motor to be cooled.

A further significant advantage is that the heat exchanges are optimized. In this connection, the first conduit 61 enables the working fluid used for cooling to be supplied in measured amounts.

The invention thus conceived is susceptible of numerous modifications and variations, all of which are within the scope of the inventive concept that characterizes it. Furthermore, all the details may be replaced with other technically equivalent elements. In practice, all the materials used, as well as the dimensions, may be any, according to requirements.

What is claimed is:

1. A pump comprising:

pumping means (2) for pumping a working fluid;

an electric motor (3) for actuating the pumping means (2); said motor (3) comprising a stator (31) and a rotor (32) that interact for actuation of the pumping means (2); said rotor (32) being rotatable about an axis of rotation (320);

an electronic unit (4) for controlling the electric motor (3);

a delivery conduit (5) for delivery of the working fluid downstream of the pumping means (2);

a cooling line (6) for cooling the electric motor (3) and the electronic unit (4), said cooling line (6) being permanently open and drawing off some of the working fluid processed by the pumping means (2);

an outer shell (8) which at least partially encloses the motor (3);

characterized in that the cooling line (6) comprises:

a first conduit (61) which is developed from a delivery area (22) of the pumping means (2); the delivery conduit (5) and the first conduit (61) being developed from a high pressure area of the pumping means (2);

ii) at least a first cavity (621) in which said working fluid circulates, the first cavity (621) being located downstream of the first conduit (61); a passage from the first conduit (61) to the first cavity (621) being marked by a change in direction of the working fluid; and the first conduit (61) and the first cavity (621) conveying the working fluid away from the pumping means (2); the first cavity (621) being partially defined by the stator (31) and partially by the shell (8); said first conduit (61) having progressively decreasing transverse sections.

2. The pump according to claim 1, characterized in that said first conduit (61) is developed longitudinally and has convex orthogonal sections.

3. The pump according to claim 1, characterized in that said first conduit (61) being surrounded and defined by said shell (8).

4. The pump according to claim 3, characterized in that said shell (8), which at least partially encloses the motor (3) and surrounds and defines the first conduit (61), is a single one-piece body.

5. The pump according to claim 1, characterized in that the pump comprises a housing (40) of the electronic unit (4); the cooling line (6) comprising:

a heat exchange manifold (92) which contacts a wall (41) of said housing (40) and which receives the working fluid from said at least one first cavity (621); and channels connected in parallel, wherein the channels extend from said heat exchange manifold (92) towards the pumping means (2), passing through the stator (31) of the motor (3).

6. The pump according to claim 1, characterized in that said first conduit (61), extending away from the pumping means (2), extends away from said axis of rotation (320) of the rotor (32).

7. The pump according to claim 1, characterized in that the pump comprises a housing (20) of said pumping means (2); the first conduit (61) being developed from said housing (20) of the pumping means (2) and having a straight longitudinal axis of development.

8. The pump according to claim 1, characterized in that at least one imaginary straight line (7), parallel to the axis of rotation (320), intercepts said motor (3), said electronic unit (4) and said pumping means (2).

9. The pump according to claim 2, characterized in that said first conduit (61) being surrounded and defined by said shell (8).

10. The pump according to claim 9, characterized in that said shell (8), which at least partially encloses the motor (3) and surrounds and defines the first conduit (61), is a single one-piece body.

11. The pump according to claim 10, characterized in that the pump comprises a housing (40) of the electronic unit (4); the cooling line (6) comprising:

a heat exchange manifold (92) which contacts a wall (41) of said housing (40) and which receives the working fluid from said at least one first cavity (621); and channels connected in parallel, wherein the channels extend from said heat exchange manifold (92) towards the pumping means (2), passing through the stator (31) of the motor (3).

12. The pump according to claim 11, characterized in that said first conduit (61), extending away from the pumping means (2), extends away from said axis of rotation (320) of the rotor (32).

13. The pump according to claim 12, characterized in that the pump comprises a housing (20) of said pumping means (2); the first conduit (61) being developed from said housing (20) of the pumping means (2) and having a straight longitudinal axis of development.

14. The pump according to claim 13, characterized in that at least one imaginary straight line (7), parallel to the axis of rotation (320), intercepts said motor (3), said electronic unit (4) and said pumping means (2).

* * * * *